US008895915B2

(12) United States Patent
Schwieters et al.

(10) Patent No.: US 8,895,915 B2
(45) Date of Patent: Nov. 25, 2014

(54) ION DETECTION ARRANGEMENT

(75) Inventors: Johannes Schwieters, Ganderkesee (DE); Michael Krummen, Bad Zwischenahn (DE); Dougal Hamilton, Cheshire (GB)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 13/809,850

(22) PCT Filed: Jul. 14, 2011

(86) PCT No.: PCT/EP2011/062095

§ 371 (c)(1), (2), (4) Date: Jan. 11, 2013

(87) PCT Pub. No.: WO2012/007559

PCT Pub. Date: Jan. 19, 2012

(65) Prior Publication Data

US 2013/0112868 A1 May 9, 2013

(30) Foreign Application Priority Data

Jul. 14, 2010 (GB) ..... 1011862.8

(51) Int. Cl.

| | |
|---|---|
| ***H01J 49/26*** | (2006.01) |
| ***H01J 49/02*** | (2006.01) |
| ***H01J 49/06*** | (2006.01) |
| ***H01J 49/00*** | (2006.01) |

(52) U.S. Cl.

CPC ..... *H01J 49/26* (2013.01); *H01J 49/025* (2013.01); *H01J 49/06* (2013.01); *H01J 49/0031* (2013.01)

USPC ..... 250/281; 250/283

(58) Field of Classification Search

USPC ..... 250/281, 282, 283

See application file for complete search history.

(56) References Cited

U.S. PATENT DOCUMENTS

| | | | | |
|---|---|---|---|---|
| 5,091,645 | A | 2/1992 | Elliott | |
| 5,723,862 | A | 3/1998 | Forman | |
| 2001/0030284 | A1 * | 10/2001 | Dresch et al. | 250/287 |

(Continued)

FOREIGN PATENT DOCUMENTS

| | | |
|---|---|---|
| GB | 2240215 A | 7/1991 |
| JP | 52-41583 | 3/1977 |

(Continued)

OTHER PUBLICATIONS

Morgan and Beynon, The MM-ZAB-2F Double-Focusing Mass Spectrometer and Mike Spectrometer, International Journal of Mass Spectrometry and Ion Physics, 28 (1978) 171-191.

*Primary Examiner* — Nicole Ippolito
(74) *Attorney, Agent, or Firm* — Charles B. Katz

(57) ABSTRACT

A mass spectrometer is disclosed having a mass analyzer with a mass-to-charge dispersive element for separating ions according to their mass-to-charge ratios along a dispersive plane and an ion deflector to deflect ions leaving the mass analyzer in the dispersive plane. A shielding arrangement, located between the dispersive element and the ion deflector is arranged to define the portion of the beam to be deflected by the ion deflector. The deflected beam is steered onto a beam defining aperture, located at the focal plane of the mass analyzer is detected by at least one ion detector, located downstream from the beam defining aperture.

28 Claims, 8 Drawing Sheets

(56) References Cited

U.S. PATENT DOCUMENTS

| | | | | |
|---|---|---|---|---|
| 2002/0043621 | A1* | 4/2002 | Aitken | 250/281 |
| 2005/0279933 | A1 | 12/2005 | Appelhans et al. | |
| 2007/0029473 | A1* | 2/2007 | Verentchikov | 250/281 |

FOREIGN PATENT DOCUMENTS

| | | |
|---|---|---|
| JP | 54-94092 | 7/1979 |
| JP | 56-143649 | 11/1981 |
| WO | 9715944 | 5/1997 |

* cited by examiner

ION DETECTION ARRANGEMENT

TECHNICAL FIELD OF THE INVENTION

The present invention relates to a mass spectrometer, specifically its ion detection arrangements. The invention also relates to a method of operating a mass spectrometer.

BACKGROUND TO THE INVENTION

Multicollector mass spectrometers are well-known, particularly for distinguishing between isotopes. The detector array may be fixed or movable. Moreover, the distancing between detectors may be fixed within a moveable array. Flexibility of the mass spectrometer for dealing with ions of different types is a consideration in their design.

WO-97/15944 shows a multicollector mass spectrometer comprising a mass analyzer having a magnetic sector. A zoom lens is positioned in the path of the ion beam between the output of the mass analyzer and the collector array ion detectors. Where the spacing of the separated ions separated by the mass analyzer does not precisely match the spacing of the collector array, the zoom lens can provide a small adjustment as a correction.

EP-0952607 also describes an isotopic ratio mass spectrometer, comprising a mass analyzer having a magnetic sector. The detector arrangement, downstream from the mass analyzer, comprises a number of detectors. Each detector has a beam defining aperture positioned at the focal plane of the mass analyzer. For one of the detectors, a deflector is positioned downstream from the beam defining aperture and upstream from the collection electrode. The ion deflector comprises a pair of cylindrical electrodes with a radius, sector angle and applied potentials selected to deflect ions having the correct initial ion energy that passed through the slit at the entrance to the detector into the collection electrode.

U.S. Pat. No. 5,091,645 concerns a sector mass spectrometer, with two apertures located in its focal plane. The apertures are separated in a plane that is perpendicular to the sector analyzer's dispersive plane (also referred to as the analysing plane). An electrostatic deflector is placed upstream from the apertures to direct the ions selectively towards one of the apertures. In this way, the ion deflector acts along an axis that is perpendicular to the dispersive plane, so that it does not interfere with the mass-selective dispersion of the ions.

Also known is the Axiom mass spectrometer, originally manufactured by VG Elemental. In one option of this instrument, three large electron multiplier detectors were used, in view of their superior performance in comparison with smaller detectors. Three beam defining apertures were positioned in the focal plane of the mass analyzer, two of which were moveable. In order to disperse adjacent high mass beams more widely so as to make use of these large detectors, closely-spaced electrically-coupled deflector pins were placed just upstream of and were symmetrically disposed either side of the fixed central (axial) aperture. These were used to increase the separation of the beams adjacent the axial location. Between the symmetrically disposed pins, the central aperture accepted an undeflected ion beam through an earthed channel. Ion deflector plates were located downstream from the apertures to direct the ions passing through the outer two apertures towards the detectors.

All of these existing systems lack flexibility when dealing with ions with a range of different mass-to-charge-ratios, which is particularly desirable for isotopic ratio mass spectrometry. They also have difficulties in providing both high and low resolution mass spectra using the same instrument.

SUMMARY OF THE INVENTION

Against this background, there is provided a mass spectrometer, comprising: a mass analyzer, comprising a mass-to-charge dispersive element, the mass analyzer being arranged to receive ions, to separate the ions according to their mass-to-charge ratios along a dispersive plane and to focus the ions in a beam at a focal plane; an ion deflector, arranged downstream from the dispersive element to deflect ions leaving the mass analyzer in the dispersive plane; a shielding arrangement, located between the dispersive element and the ion deflector and being arranged to define the portion of the beam to be deflected by the ion deflector; a beam defining aperture, located downstream from the ion deflector and substantially at the focal plane of the mass analyzer; and at least one ion detector, located downstream from the beam defining aperture.

In another sense, the present invention may be found in a mass spectrometer having a dispersion element, with a deflector near the focal plane arranged to provide a non-zero force that steers a plurality of dispersed ion beams individually or independently into a detector opening, so as to correct for small mass or dispersion errors. The dispersed ion beams are thereby projected into one or more detectors. Advantageously, the ion deflector is arranged to deflect ions on the basis of the mass-to-charge ratio of the ions and the degree of mass-to-charge separation caused by the dispersive element. Optionally, the mass spectrometer further comprises a controller arranged to control the ion deflector to deflect ions leaving the mass analyzer in the dispersive plane on the basis of one or more of: the mass-to-charge ratio of the ions; and the degree of mass-to-charge separation caused by the dispersive element.

The use of an ion deflector, upstream from the beam defining aperture means that individual ion beams can be steered onto the beam defining openings positioned in the focal plane of the mass analyzer. Steering the beams onto the apertures, rather than onto the detectors, significantly improves the flexibility of the mass spectrometer. Where fixed ion detectors are used, a greater range of mass-to-charge ratios can be measured. Where moveable detectors are employed, the requirements for their exact positioning are reduced, since the ion deflectors can adjust the beam positioning. Moreover, different widths of beam defining aperture can be used more easily. Accurate positioning of the beam defining apertures for high and low resolution is unnecessary.

This allows the spacing of individual ion beams to be changed by the ion deflector. Moreover, a separate ion deflector can act individually for each ion beam. For instance, the spacing of two adjacent ion beams may be narrowed, whilst the spacing between two other adjacent ion beams may be increased at the same time. This can be carried out completely independently, unlike conventional zoom lenses in which the deflection of one ion beam is related to the deflection of each other ion beam.

Rather than using just one optical system for all ion beams of interest, such as with a zoom lens, using individual deflectors for each ion beam provides significant advantages, for example enabling different operation modes. For instance, beam diagnostics can be effected by deflecting each individual ion beam across the detector slit independently.

The mass analyzer comprises a dispersive element which disperses ions according to their mass-to-charge ratios. The dispersion is an angular dispersion across a plane. The plane is herein termed the dispersive or analysing plane. Optionally, the dispersive element comprises a magnetic sector. Additionally or alternatively, the dispersive element may comprise an electric sector.

The mass analyzer causes the dispersed ions to be focused at least in the dispersive plane so that ions of different mass to charge ratios come to be focused at different focal points on a focal plane. This facilitates distinguishing the different species of ions. Preferably, the focusing action is accomplished by the dispersive element of the mass analyzer alone, but it may be assisted by one or more lenses.

As well as focusing in the dispersive plane, ions may be focused or at least have their divergence limited by focal action in the non-dispersive plane. This focal action in the non-dispersive plane is also preferably accomplished by the dispersive element of the mass analyzer alone, but may also be assisted or be entirely accomplished by the use of other lenses. Preferably the ions are also energy focused at the focal plane, but where ion sources are used which generate ions of sufficiently low energy spread, such as for example thermal ionisation sources, no energy focusing may be necessary. The present invention does not require either energy focusing or focal action in the non-dispersive plane.

The shielding arrangement defines the volume of space within which the electrostatic field generated at the ion deflector permeates. In other words, the shielding arrangement defines the range over which the ion deflector has an effect. This helps to prevent an ion deflector from causing deflections to an ion beam intended for a different detector. In this way, the ion deflector only affects beams intended for its downstream detector.

Advantageously, the shielding arrangement comprises a beam limiting aperture, having a width so as to define the beam from the dispersive element in the dispersive plane. Optionally, the beam defining aperture has a width in the dispersive plane that is narrower than the width of the beam limiting aperture. Consequently, whilst the beam limiting aperture located upstream from the ion deflector can act to define the beam in the dispersive or analysing plane, its effect is significantly less than the beam defining aperture.

Beneficially, the shielding arrangement further comprises a housing that is arranged to shield the ion deflector from other parts of the mass spectrometer, particularly other ion deflectors. Preferably, the shielding arrangement is connected to ground or configured to be connected to ground.

Although the beam defining aperture is optionally located at the focal plane, it need not be positioned precisely at this location. It can be located at or around or near the focal plane. In some embodiments, the beam defining aperture is at a location displaced from the focal plane by a distance that is small in comparison with the depth of focus of the mass analyzer. The distance is optionally no greater than 25% of the depth of focus of the mass analyzer. Alternatively, the distance is no greater than 10% or 5% or 2% or 1% or 0.5% or 0.1% of the depth of focus of the mass analyzer. Thus, the beam defining aperture need not be located precisely within the focal plane of the mass analyzer. However, any deviation from the focal plane is desirably small. Optionally, the beam defining aperture is closer to the focal plane than any other component of the detection arrangement.

The ion deflector may optionally be any type of deflection means which, when energised, deflects the ion beam. The ion deflector may beneficially utilise electric or magnetic fields. Preferably the ion deflector utilises an electrostatic field and comprises at least one electrode, wherein the at least one electrode may be any suitable shape. Advantageously, a plate electrode is used.

In preferred embodiments, the ion deflector comprises at least one electrode coupled to a voltage source for generating an electric field to deflect ions passing through the field. The voltage source provides a potential to the electrode to generate the field. Optionally, two electrodes are used. Using two electrodes has the advantage that deflections in both directions can be done using one power supply that provides a potential of a single polarity only.

The potential applied to each of the two electrodes may be positive or negative. The potential applied to one of the two electrodes may be of opposite polarity to the potential applied to the other electrode. If negative ions are being measured, opposite polarity potentials may be applied to the two electrodes compared with when they are used for positive ions. Opposite polarity potentials may also be applied to the two electrodes to achieve deflections in both directions.

In one embodiment, the mass spectrometer further comprises a controller, arranged selectively to set the voltage source to provide a first potential such that ions are deflected by the ion deflector by a first amount and to provide a second potential such that the ions are deflected by the ion deflector by a second amount. Preferably, the first potential and second potential are different. Optionally, the first amount and second amount are different. In a preferred embodiment, the first amount is zero. The ion deflector can therefore distinguish between different species of ion, or between a beam that can overload the detectors from one that would not, or both.

In embodiments, the beam defining aperture is a first beam defining aperture of a first width, the mass spectrometer further comprising a second beam defining aperture of a second width, located downstream from the ion deflector and at the focal plane of the mass analyzer, the at least one ion detector being located downstream from the second beam defining aperture. The mass spectrometer may further comprise a controller arranged to control the ion deflector to deflect separated ions such that some of the separated ions pass through the first beam defining aperture and some of the separated ions pass through the second beam defining aperture. The first and second widths are advantageously in the dispersive plane. Optionally, the first width and second width are different. In this case, the first width may define a low resolution aperture and the second width may define a high resolution aperture.

In another embodiment, the mass spectrometer further comprises a controller, arranged to set the voltage source to provide a potential such that ions of a first range of mass-to-charge ratios are deflected by the ion deflector by a first amount and such that ions of a second range of mass-to-charge ratios are deflected by the ion deflector by a second amount.

In any of these embodiments, optionally, the first amount is zero and the second amount is greater than zero.

In an alternative embodiment, the ion deflector is a first ion deflector, the beam defining aperture is a first beam defining aperture and the at least one ion detector is at least one first ion detector. Then, the mass spectrometer may further comprise: a second ion deflector, located downstream from the dispersive element; a second beam defining aperture; and at least one second ion detector, located downstream from the second beam defining aperture and spaced from the at least one first ion detector by a predetermined distance in the dispersive plane. In this way, the ion deflectors can be used to adjust the beam arriving at each ion detector individually. This allows improved detection of different isotope sets without the need to adjust the relative separation of the ion detectors. A zoom lens can optionally be used in addition to this arrangement, but this is not essential. Existing arrangements require a zoom lens, which affects all of the ion beams in a related way. Contrastingly, the present invention can control ion beams individually.

In a general sense, the invention may be found in a mass spectrometer comprising: a mass analyzer, comprising a mass-to-charge dispersive element, the mass analyzer being arranged to receive ions, to separate the ions according to their mass-to-charge ratios along a dispersive plane and to focus the ions in a beam at a focal plane; a plurality of ion deflectors, arranged downstream from the dispersive element to deflect ions leaving the mass analyzer in the dispersive plane; a shielding arrangement, located between the dispersive element and the plurality of ion deflectors and being arranged to define portions of the beam to be deflected by the plurality of ion deflectors; a plurality of beam defining apertures, located downstream from the plurality of ion deflectors and substantially at the focal plane of the mass analyzer; and a plurality of ion detectors, located downstream from the beam defining aperture. One or more of the plurality of ion detectors may be located downstream from each of the plurality of beam defining apertures. Each one of the plurality of ion detectors may spaced from each other of the plurality of ion detectors by a predetermined distance in the dispersive plane.

Preferably, the first ion deflector comprises at least one first electrode coupled to a voltage source for generating a first potential to deflect ions passing through the first ion deflector and the second ion deflector comprises at least one second electrode coupled to a voltage source for generating a second potential to deflect ions passing through the second ion deflector. Optionally, the first potential and the second potential are different.

In some embodiments, the at least one ion detector is located at a fixed position. Alternatively, the at least one ion detector is moveable. In cases where there is a plurality of ion detectors, the spacing between the ion detectors is preferably fixed.

Optionally, the at least one ion detector comprises a collector, such as a Faraday cup. Alternatively or additionally, the at least one ion detector comprises a secondary electron multiplier, using discrete dynodes, or a channeltron. Microchannel plates may also be used. Alternatively or additionally, the at least one ion detector comprises one or more of: a Daly detector, a charge-coupled device or any other type of charged particle detection means.

In a second aspect, the present invention provides a method of operating a mass spectrometer, comprising: receiving ions at a mass analyzer; separating the received ions along a dispersive plane according to their mass-to-charge ratios using a dispersive element of the mass analyzer; causing the separated ions to be focused in a beam at a focal plane; deflecting separated ions downstream of the dispersive element using an ion deflector, such that at least some of the separated ions pass through a beam defining aperture, located substantially at the focal plane; providing shielding between dispersive element of the mass analyzer and the ion deflector so as to define the portion of the beam leaving the mass analyzer to be deflected; and detecting ions passing through the beam defining aperture.

Preferably, the shielding arrangement comprises a beam limiting aperture. Then, the method may further comprise: causing separated ions to pass through the beam limiting aperture, the beam limiting aperture having a width so as to define the beam from the mass analyzer in the dispersive plane; and wherein the beam defining aperture has a width in the dispersive plane that is narrower than the width of the beam limiting aperture.

Preferably, the beam defining aperture is at or near the focal plane. Optionally, the beam defining aperture is at a location displaced from the focal plane by a distance that is small in comparison with the depth of focus of the mass analyzer. The distance is optionally no greater than 25% of the depth of focus of the mass analyzer. Alternatively, the distance is no greater than 10% or 5% or 2% or 1% or 0.5% or 0.1% of the depth of focus of the mass analyzer.

In some embodiments, the step of deflecting ions is carried out using an ion deflector comprising at least one plate electrode coupled to a voltage source for generating a potential to deflect ions passing through the ion deflector. Optionally, the step of deflecting ions comprises selectively setting the voltage source: to provide a first potential such that ions are deflected by the ion deflector by a first amount; and to provide a second potential such that the ions are deflected by the ion deflector by a second amount. The first potential and second potential are advantageously different.

In embodiments, the ions received by the mass analyzer comprise ions of a first species and ions of a second species. Then, the step of deflecting ions separated by the mass analyzer is such that ions of the first species separated by the mass analyzer pass through the beam defining aperture and ions of the second species separated by the mass analyzer do not pass through the beam defining aperture.

Optionally, the step of deflecting ions comprises: setting the voltage source to provide a potential such that ions of a first range of mass-to-charge ratios are deflected by the ion deflector by a first amount; and setting the voltage source to provide a potential such that ions of a second range of mass-to-charge ratios are deflected by the ion deflector by a second amount.

The first amount is preferably different from the second amount. Optionally, the first amount is zero and the second amount is greater than zero.

In another aspect, a method of operating a mass spectrometer is provided, comprising: obtaining a first mass spectrum for a combination of ions of a first species and ions of a second species; obtaining a mass spectrum for ions of the first species by carrying out the method described herein above. Then, the mass spectrum for ions of the first species is optionally obtained at a higher resolution than the resolution of the first mass spectrum.

In some embodiments, the beam defining aperture is a first beam defining aperture and the step of detecting ions is carried out in a first detector. Then, the method may further comprise: deflecting ions separated by the mass analyzer, such that at least some of the separated ions pass through a second beam defining aperture, located at or near the focal plane; and detecting ions passing through the second beam defining aperture in a second detector, located a predetermined distance from the first detector in the dispersive plane. In preferred embodiments, the step of deflecting ions such that at least some of the separated ions pass through a first beam defining aperture comprises applying a first potential to at least one first plate electrode, and the step of deflecting ions such that at least some of the separated ions pass through a second beam defining aperture comprises applying a second potential to at least one second plate electrode. More preferably, the first potential is different from the second potential.

In particular embodiments, the ions received at the mass analyzer are a first set of ions and the step of separating the received ions along a dispersive plane according to their mass-to-charge ratios comprises operating the dispersive element at a first setting. Then, the step of deflecting separated ions may comprise setting one or more ion deflectors to a first setting. Preferably, the method further comprises: receiving a second set of ions at the mass analyzer; separating the second set of received ions along a dispersive plane according to their mass-to-charge ratios using the dispersive element; causing the second set of separated ions to be focused at a focal plane; deflecting the second set of separated ions downstream of the dispersive element using the one or more ion deflectors, such that at least some of the separated ions pass through the beam defining aperture; providing shielding between the dispersive element of the mass analyzer and the plurality of ion deflectors so as to define the portion of the beam leaving the mass analyzer to be deflected; and detecting the second set of ions passing through the beam defining aperture. In this case, the step of separating the second set of received ions comprises operating the dispersive element at a second setting and the step of deflecting the second set of separated ions comprises setting the one or more ion deflectors to a second setting.

This can have a number of different effects. Operating the dispersive element at a first setting may allow projection of the first set of ions onto the detectors. Similarly, operating the dispersive element at a second setting may allow projection of the second set of ions onto the detectors. Then, setting the deflectors to a first setting may then achieve optimal entry of the first ions beams into the detector openings and setting the deflectors to a second setting may achieve optimal entry of the second ions beams into the detector openings.

In other approaches, operating the dispersive element at a first setting may allow projection of the first set of ions onto a plurality of detectors in a first association between mass-to-charge ratios and the plurality of detectors. Operating the dispersive element at a second setting may allow projection of the second set of ions onto the plurality of detectors in a second association between mass-to-charge ratios and the plurality of detectors. Moreover, setting the deflectors to a first setting may allow optimal entry of the first ions beams into the respective beam defining aperture of each of the plurality of detectors. Also, setting the deflectors to a second setting may allow optimal entry of the second ions beams into the respective beam defining aperture of each of the plurality of detectors.

Preferably, the first setting and second setting for the dispersive element are different. Additionally or alternatively, the first setting and second setting for the deflectors may also be different. This approach can allow the deflectors to adapt for different types of ions.

In some embodiments, the step of detecting ions is carried out using an ion detector located at a fixed position. Alternatively, the ion detector is moveable. Optionally, the step of detecting ions is carried out using a plurality of ion detectors. Then, the ion detectors may be fixed or moveable, but the spacing between the ion detectors is advantageously fixed.

In some embodiments, the step of detecting ions is carried out using a collector, such as a Faraday cup. Alternatively or additionally, the step of detecting ions is carried out using a secondary electron multiplier, using discrete dynodes, or a channeltron. Microchannel plates may also be used. Alternatively or additionally, the at least one ion detector comprises one or more of: a Daly detector, a charge-coupled device or any other type of charged particle detection means.

The present invention may be seen as a method of operating a mass spectrometer, comprising: setting a plurality of collectors of a multi-collector ion detection arrangement to provide a first detection accuracy when each of a plurality of ion beams is incident on a respective collector; and electrically setting at least one of the plurality of ion beams to provide a second detection accuracy, which is higher than the first detection accuracy.

Preferably, the plurality of ion beams comprise at least three ion beams. Advantageously, the plurality of collectors comprise at least three collectors. Optionally, the step of setting a plurality of collectors of a multi-collector ion detection arrangement comprises adjusting a plurality of collectors of a multi-collector ion detection arrangement. Additionally or alternatively, the step of electrically setting at least one of the plurality of ion beams comprises electrically adjusting at least one of the plurality of ion beams. This method may optionally be combined with any of the methods described above. Moreover, the invention may also be provided by a mass spectrometer comprising means arranged to carry out this method.

In yet further aspects, the present invention may be found in a method of operating a mass spectrometer, comprising: operating a dispersive element to set a plurality of ion beams in a first position, each ion beam comprising ions of a respective mass-to-charge ratio; setting a plurality of ion deflectors to affect the path of one or more of the plurality of ion beams to a respective collector in a multi-collector detection arrangement; obtaining at least one first output from the plurality of collectors; operating the dispersive element to change the plurality of ion beams to a second position; adjusting the plurality of ion deflectors to affect the path of one or more of the plurality of ion beams to a respective collector; obtaining at least one second output from the plurality of collectors; comparing a selected first output for an ion beam of a certain mass-to-charge ratio with a selected second output for an ion beam of the same certain mass-to-charge ratio, the second output being obtained from a different collector than the first output; and correcting a difference between the selected first output and the selected second output by changing a gain for one or more of the plurality of collectors or by numeric correction.

Advantageously, the step of setting the plurality of ion deflectors is carried out to allow cross-calibration of the plurality of collectors. Beneficially, the step of setting the plurality of ions deflectors, adjusting the plurality of ions deflectors or both may be carried out to maximize the ion signals of each of the plurality of ion detectors. Preferably, the plurality of ion beams comprise at least three ion beams. Advantageously, the plurality of collectors comprise at least three collectors. This method may optionally be combined with any of the methods described above. Moreover, the invention may also be provided by a mass spectrometer comprising means arranged to carry out this method.

It will also be understood that the present invention is not limited to the specific combinations of features explicitly disclosed, but also any combination of features that are described independently and which the skilled person could implement together.

BRIEF DESCRIPTION OF THE DRAWINGS

The invention may be put into practice in various ways, a number of which will now be described by way of example only and with reference to the accompanying drawings in which.

SPECIFIC DESCRIPTION OF PREFERRED EMBODIMENTS

Figure 1:
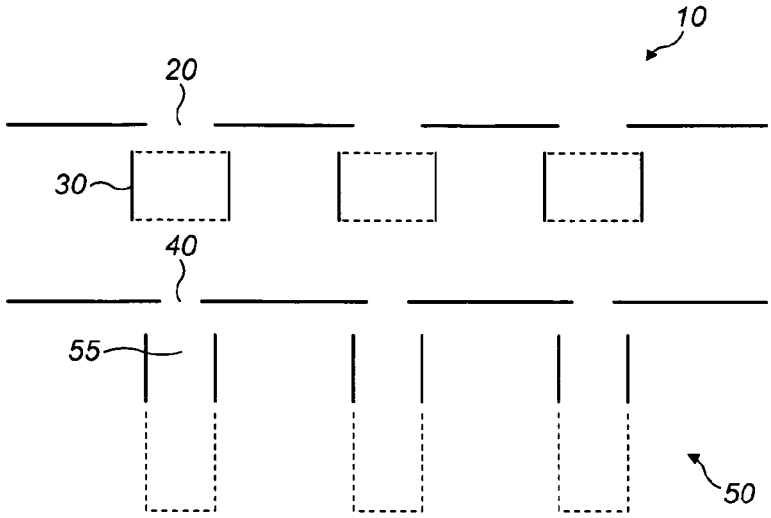
FIG. 1 shows a schematic diagram illustrating an ion detection arrangement in accordance with the present invention.

Referring first to FIG. 1, there is shown an ion detection arrangement 10 according to the present invention. The ion detection arrangement 10 comprises: a first slit plane defining a beam limiting aperture 20; an ion deflector 30; a second slit plane providing a beam defining aperture 40; and a detector array 50.

In use, an ion beam dispersed from the mass-to-charge dispersive element of a mass analyzer (not shown), upstream from the ion detection arrangement, passes through the beam limiting aperture 20 and through ion deflector 30. Ion deflector 30 may cause the ion beam to be deflected. The ion beam then passes through beam defining aperture 40, which is narrower in width than beam limiting aperture 20. The portion of the ion beam passing through the beam defining aperture 40 is then detected in detector 55, which forms part of detector array 50.

Figure 2:
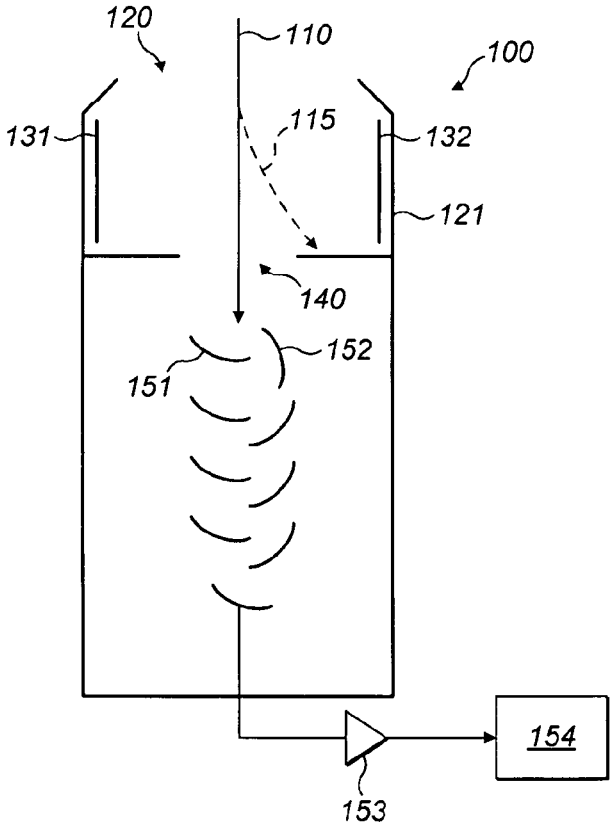
FIG. 2 shows a first embodiment of the present invention.

Referring now to FIG. 2, there is shown a first embodiment of the present invention. This is an ion detection arrangement 100, comprising: entrance opening 120; housing 121; first steering plate electrode 131; second steering plate electrode 132; beam defining aperture 140; conversion dynode 151; ion counter dynode 152; amplifier 153; and detection electronics 154.

In this case, the deflection plate electrodes 131 and 132 are placed in front of the detector beam defining aperture 140 in order to prevent ions in beam 110 from entering the sensitive detection system. The housing 121 provides shielding for the deflection plate electrodes 131 and 132. Although the detector shown is a secondary electron multiplier of discrete dynode type, any detection system which needs to be protected against overloading from high intensity beams may be used with this embodiment. A secondary electron multiplier of continuous dynode type or a sensitive analogue current amplifier could alternatively be used, for instance. The steering plate may, for example, be used for "beam adjustment" as discussed below with reference to FIG. 3, 5 or 6.

A significant overload of the detector as a worse case scenario could result in the destruction of the detector. Typical potentials for deflecting 10 kV ions are in the range of plus or minus a few hundred volts, but up to 3 kV may be applied for complete elimination of a mass peak.

Ion beam 110 passes through entrance opening 120 and, under normal operating conditions, passes through the first steering plate electrode 131 and second steering plate electrode 132 without being deflected and towards the secondary electron multiplier detector. When the detector needs to be protected, the steering plate electrodes 131 and 132 are set to an appropriate potential so as to deflect the ion beam away from the detector slit, for example along ion beam path 115, so that no ions pass through the beam defining aperture 140 and enter the detector. The purpose of the steering plate electrodes is to generate a deflection force on the ions on their way to the detector slit, which is the beam defining aperture 140.

The powering of the beam steering plate electrodes 131 and 132 may be synchronised with beam scanning operations in a mass analyzer, such that the ion beam is always deflected in the case where a large intensity ion beam can hit the detector. When the detected ion intensity exceeds a defined limit, the deflection plate electrodes 131 and 132 can be used to switch off the ion beam by deflecting the ion beam away from the detector slit, along ion beam path 115. This can be an automated protection mechanism for a sensitive detector. When ions of different masses from those intended for measurement arrive at the detector arrangement, the deflector would be powered to deflect away the ions for protection, or to bring them into the correct or optimum beam position.

Optionally, deflection plate electrode 132 can be omitted and a positive or negative potential is applied to deflection plate electrode 131. The positioning of the deflection plate electrode 131 can be adjusted accordingly.

Figure 3:
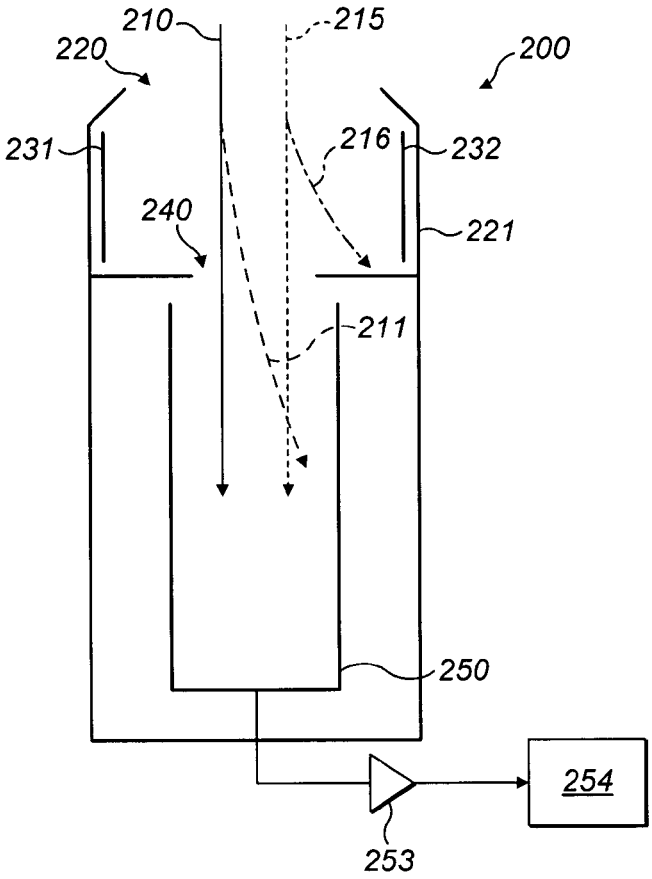
FIG. 3 shows a second embodiment of the present invention.

Referring now to FIG. 3, there is shown a second embodiment of the present invention. This ion detection arrangement 200 comprises: entrance opening 220; housing 221; first steering plate electrode 231; second steering plate electrode 232; beam defining aperture 240; collector element 250; amplifier 253; and detection electronics 254.

In this embodiment, a first ion beam 210 and a second ion beam 215 are shown. The first ion beam 210 relates to a first species of ion, and the second ion beam 215 relates to a second species. The two ion beams 210 and 215 are separated in space, but both enter the ion detection arrangement 200 through beam limiting aperture 220, such that there is interference between the ion beams.

Figure 4A:
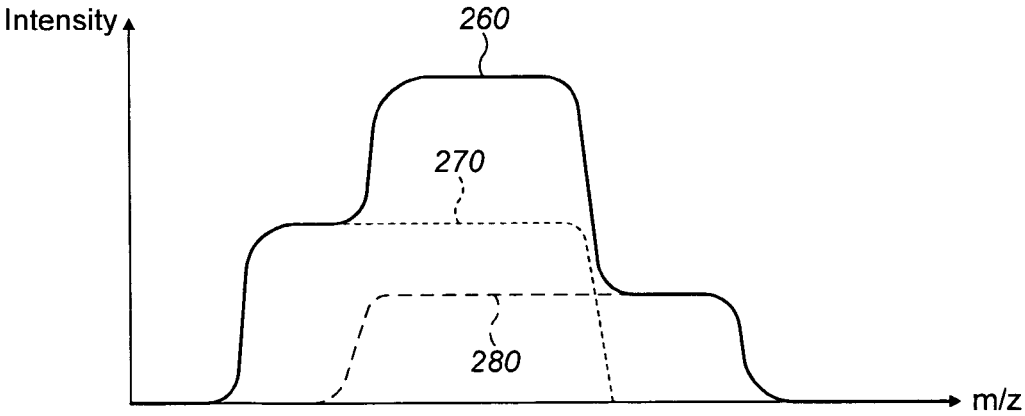
FIG. 4A shows a mass spectrum produced by the embodiment of FIG. 3 operating in a first mode.
Figure 4B:
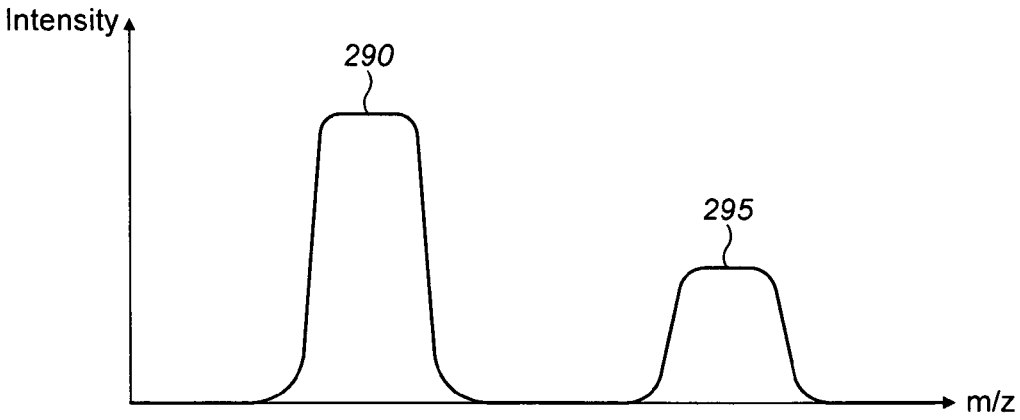
FIG. 4B shows a processed mass spectrum resulting from the operation of the embodiment of FIG. 3.

In a first mode of operation, the doublet of both ion beams 210 and 215 is caused to pass through beam defining aperture 240 and a mass spectrum is produced. The resultant mass spectrum 260 is shown is FIG. 4A. The contribution of the first species in ion beam 210 is illustrated by mass spectrum 270 and the contribution of the second species in ion beam 215 is illustrated by mass spectrum 280. A characteristic step function results in the obtained mass spectrum 260.

Where the dispersive element of the mass analyzer (not shown) is tuned to transmit a certain range of mass-to-charge ratio ions, the deflection plate electrodes 231 and 232 can alone be used for beam diagnostics. In a first setting, in which a first potential is applied to the deflector plate electrodes 231 and 232, the ion beam doublet is deflected such that the ions of the first species enter the detector along ion beam path 210, while all of the ions of the second species are deflected along ion beam path 216 to be stopped at the detector slit. In a second setting, both the first ion beam 210 and second ion beam 215 enter through the beam defining aperture 240 and the sum of both ion beam intensities is recorded by the detector 250. In a third setting, only the ions of the second ion beam 215 enter through the beam defining aperture 240, while all the ions of the first ion beam 210 are stopped at the detector slit and do not pass through the beam defining aperture 240. The housing 221 provides shielding for the deflection plate electrodes 231 and 232.

This makes beam diagnostics of an interfered beam bundle possible. It can also be useful as a diagnostic tool to check quickly whether there is any interference on the ion beam recorded. Moreover, it could be used to perform fine adjustment for each individual collector in a fixed collector array. The deflection plate electrodes 231 and 232 can be used to discriminate an interfering species from the species of interest.

This procedure can be used independently for each collector in a collector array. Without these deflection plates, a moveable collector array would be necessary to fine-tune the position of each collector individually, to discriminate against interference. Nevertheless, moveable collectors can be employed. Such a situation may arise in a large multicollector instrument, where individually moveable cups, cups moveable in groups (that is, a moveable cup assembly has a plurality of detectors which have fixed positions relative to one another) and fixed cups (and the channels for the energy thresholded detectors) are employed.

Where a high mass resolution setting is required, using a beam defining aperture 240 of narrow width, the spacing between the two interfering ion species may be even wider than the beam defining aperture 240. In this case, the deflection plate electrodes 231 and 232 can also be used to directly switch between the first and second species. In this case there is no chance of both ion beams entering the detector slit simultaneously, but just separately, one after the other.

Optionally, deflection plate electrode 232 can be omitted and a positive or negative potential is applied to deflection plate electrode 231. The positioning of the deflection plate electrode 231 can be adjusted accordingly.

Figure 5:
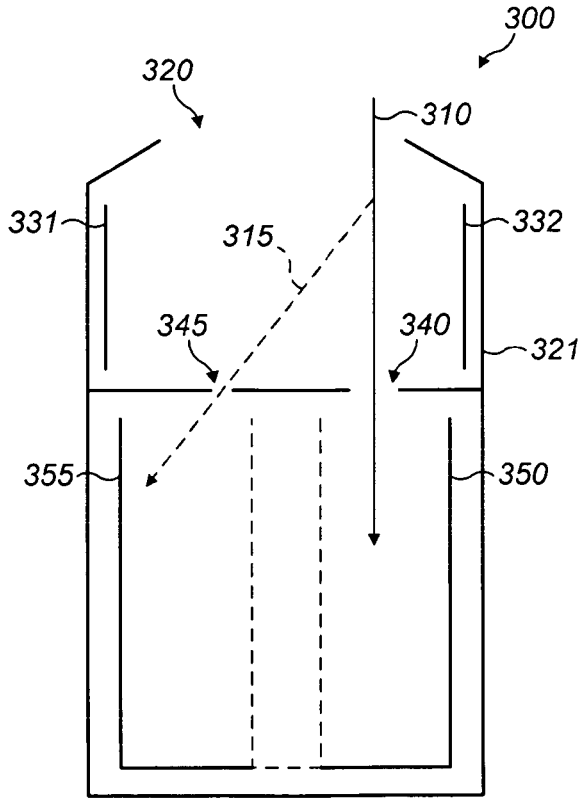
FIG. 5 shows a third embodiment of the present invention.

Referring next to FIG. 5, there is shown a third embodiment of the present invention. The ion detector arrangement 300 comprises: an entrance opening 320; housing 321; a first steering plate electrode 331; a second steering plate electrode 332; a first beam defining aperture 340; a second beam defining aperture 345; a first collector element 350; and a second collector element 355.

The first beam defining aperture 340 is relatively wide in comparison with the second beam defining aperture 345. In this embodiment, it is possible to have a high resolution detector and a low resolution detector installed into the system. The first detector 350 is a low resolution detector and the second detector 355 is of high resolution. By adjusting the potentials applied to the steering plate electrodes 331 and 332, it is possible to select whether the ion beam 310 passes through the wide beam defining aperture 340 and into the first detector 350, or along ion beam path 315 through the narrow beam defining aperture 345 and into the second detector 355. It will be recognised that positive or negative ions can be detected using this arrangement by appropriately setting the potentials. The housing 321 provides shielding for the steering plate electrodes 331 and 332.

An alternative form of this embodiment, which also extends the dynamic range of the detection system, includes a hybrid collector arrangement, for instance using an ion counting mechanism for low ion beam intensities and an analogue Faraday cup detector for larger ion beam intensities. For example, a sandwich of two detectors or more can be assembled with different sensitivities. Using the deflection plate electrodes 331 and 332, it is possible to switch the ion beam between the detectors to cover the whole dynamic range. This arrangement can also be used in a detector array, where several ion beams are recorded simultaneously. Since the deflection plate electrodes work independently for each detector, it is possible to adjust the sensitivity for each ion beam to be recorded independently.

Optionally, deflection plate electrode 332 can be omitted and a positive or negative potential is applied to deflection plate electrode 331. The positioning of the deflection plate electrode 331 can be adjusted accordingly.

Figure 5A:
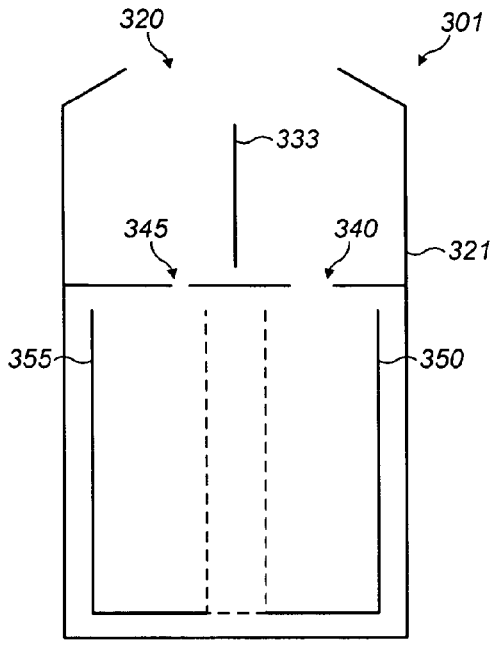
FIG. 5A shows a variant of the third embodiment shown in FIG. 5.

An alternative embodiment based on the embodiment of FIG. 5 is shown in FIG. 5A. Where the same features are indicated, identical reference numerals have been used. Rather than two plate electrodes, a single deflection electrode 333 is positioned centrally along the dispersion plane between first beam defining aperture 340 and second beam defining aperture 345. By saving electrodes in this way, especially in case of moveable detectors, the time consuming movement operations can be minimized.

Figure 6:
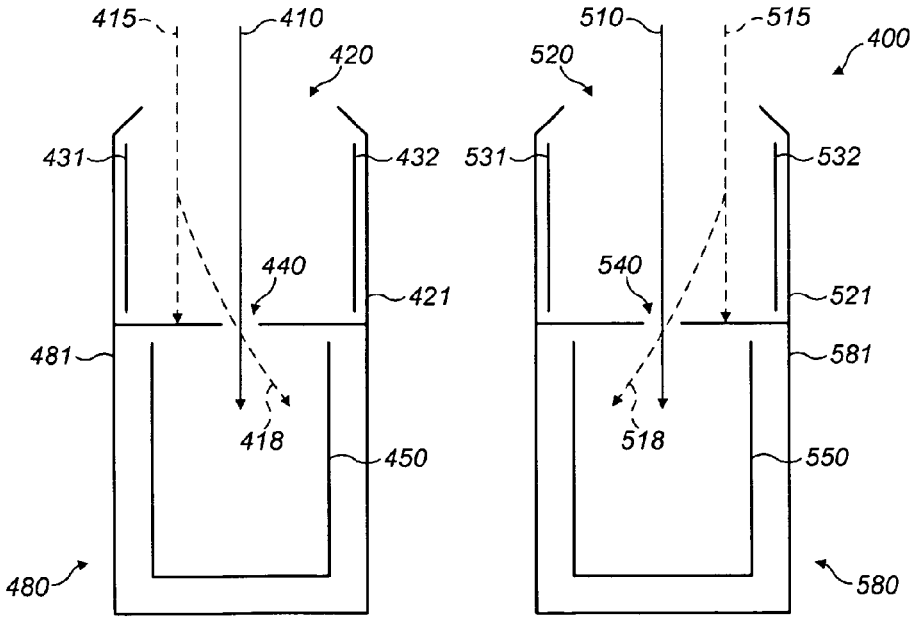
FIG. 6 shows a fourth embodiment of the present invention.

Referring now to FIG. 6, there is shown a fourth embodiment of the present invention. Ion detection arrangement 400 comprises a first detection arrangement 480 and a second detection arrangement 580. The first detection arrangement comprises: a first entrance opening 420; housing 421; first detection arrangement first steering plate electrode 431; first detection arrangement second steering plate electrode 432; first beam defining aperture 440; and first ion detector 450. The second detection arrangement 580 comprises; a second entrance opening 520; housing 521; second detection arrangement first steering plate electrode 531; second detection arrangement second steering plate electrode 532; second beam defining aperture 540; and second ion detector 550.

In this embodiment, several detectors are used in parallel for simultaneous measurements of ion beam intensities; for example in isotope ratio measurement. In such applications, the intensity of at least two isotopes has to be measured in parallel with high accuracy and precision. This can be accomplished by spacing the first ion detection arrangement 480 and second ion detection arrangement 580 appropriately. More precisely, the first collector element 450 and second collector element 550 are spaced a defined distance apart, where a first ion beam 410 of a first isotope hits the first beam defining aperture 440 in the centre and a second ion beam 510 of a second isotope hits the second beam defining aperture 540 in the centre.

However, there are applications where a different set of isotopes need to be measured using the same pair of collectors. Third ion beam 415 and fourth ion beam 515 are two different isotopes from those in first ion beam 410 and second ion beam 510. Since third ion beam 415 and fourth ion beam 515 do not have the same spacing (mass dispersion) as first ion beam 410 and second ion beam 510, they do not fit ideally into both the first beam defining aperture 440 and second beam defining aperture 540 simultaneously.

In the embodiment shown in FIG. 6, the first detection arrangement steering plate electrodes 431 and 432 and second detection arrangement steering plate electrodes 531 and 532 can be used to deflect the third ion beam 415 and fourth ion beam 515 along a third ion beam deflected path 418 and a fourth ion beam deflected path 518 respectively. Consequently, the ion beams then pass through the centre of the third beam defining aperture 440 and fourth beam defining aperture 540 respectively. This allows simultaneous measurement of these alternative isotopes in the same collector array which was originally set up for the measurement of two different isotopes. The housing 421 provides shielding for the deflection plate electrodes 431 and 432. The housing 521 provides shielding for the deflection plate electrodes 531 and 532.

Typically, the enclosure 481 of the first ion detection arrangement 480 is grounded and the enclosure 581 of the second ion detection arrangement 580 is grounded. This ensures that all potentials are well-defined. In particular, the plate defining the first beam defining aperture 440 and the plate defining the second beam defining aperture 540 are grounded. In any case, all components of the system that are in proximity to the beam have a defined potential.

In the preferred embodiment, only one steering plate electrode is employed for each detection arrangement. Optionally, first detection arrangement second steering plate electrode 432 can be omitted and a positive or negative potential is applied to first detection arrangement first steering plate electrode 431. Similarly, second detection arrangement second steering plate electrode 532 can be omitted and a positive or negative potential is applied to second detection arrangement first steering plate electrode 531. The positioning of the deflection plate electrodes 431 and 531 can be adjusted accordingly.

The one or more deflection plate electrodes allow for individual adjustments of mass dispersion between adjacent ion beams. Without the deflection plate electrode or electrodes, it would be required to move the collectors to adjust the spacing between them, depending on the mass dispersion of both ion beams. An alternative possibility would be to use a zoom lens, which acts for all ion beams simultaneously. Advantageously, the use of deflection plate electrodes, which act in the dispersive plane, in connection with a first collector 450 and a second collector 550 means that individual adjustments can be made to each ion beam as needed for the specific application.

Figure 7A:
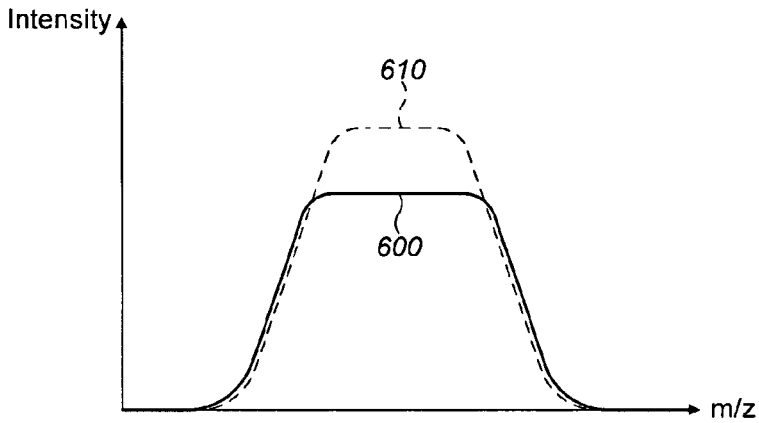
FIG. 7A shows a mass spectrum illustrating the problem solved by the embodiment of FIG. 6.

Referring to FIG. 7A, there is shown sample mass spectra for the ion detection arrangement of FIG. 6. FIG. 7A is an example of the mass spectra when a magnetic sector mass analyzer is used scanning over a peak. The deflector plate electrodes potential is set such that the first mass spectrum 600, corresponding with a first ion beam, and the second mass spectrum 610, corresponding with a second ion beam, have peaks centred at the same magnet setting (mass-to-charge ratio). A single mass can also be optimized by variation of the deflection plate electrode potential until the measured ion current maximises.

Figure 7B:
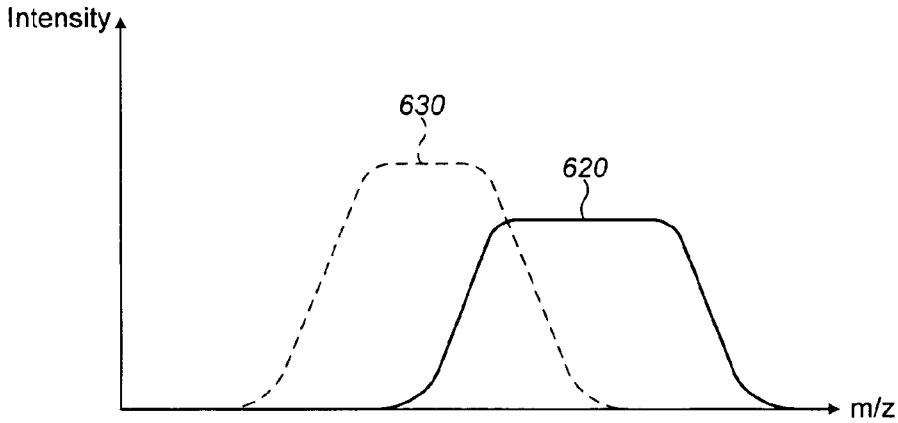
FIG. 7B shows alternative mass spectra from those shown in FIG. 7A.

In FIG. 7B, there is shown alternative sample mass spectra from those shown in FIG. 7A. The third mass spectrum 620 corresponds with first mass spectrum 600 shown in FIG. 7A, but in the case where a potential is not applied to the deflection plate electrodes. Fourth mass spectrum 630 corresponds with second mass spectrum 610 shown in FIG. 7A, but again, in a case in which a deflection potential is not applied to the plate electrodes. One could also think of a combination of a zoom lens (for all ion beams) with a fine tuning of the dispersion by use of the deflection plates.

An example of this is, for instance, the measurement of Argon isotopes in the ARGUS VI mass spectrometer, marketed by Thermo Fisher Scientific, Inc. The ARGUS VI mass spectrometer uses a magnetic sector mass analyzer. In the focal plane of the mass spectrometer the 5 Argon isotopes are physically separated by about 7 mm. The fixed collector array consists of 5 Faraday cup plus one ion counter. The desired cup configuration is as follows:

| | H2-FAR | H1-FAR | C-FAR | L1-FAR | L2-FAR | SEM |
|---|---|---|---|---|---|---|
| Configuration 1 | 40Ar | 39Ar | 38Ar | 37Ar | 36Ar | |
| Configuration 2 | | 40Ar | 39Ar | 38Ar | 37Ar | 36Ar |

In configuration 1, all Argon isotopes are measured in Faraday cups. In configuration 2, the pattern is shifted by one mass unit such that 36Ar is measured in a high sensitivity secondary electron multiplier (SEM) while all other Argon isotopes should be measured precisely in the Faraday detectors (FAR). The spacing of the ion beams is proportional to their relative mass difference. This means the spacing between 39Ar and 38Ar is slightly wider than the spacing of 40Ar and 39Ar. However, when a change is made from configuration 1 to configuration 2, it is necessary to measure 40Ar and 39Ar in a collector array which needs be compatible with spacing for 39Ar and 38Ar as well. This conflict can be resolved by the use of the deflection plates to fine tune the spacing between the ion beams in each configuration.

The following example shows typical behaviour and values for a 5-cup configuration, originally set up for measurement of Argon Isotope ratios.

| | H2 | H1 | Ax | L1 | L2 |
|---|---|---|---|---|---|
| nominal mass [u] | 40 | 39 | 38 | 37 | 36 |
| actual steering voltage [V] | 0 | 50 | 480 | 530 | 480 |
| Steering corr. [V] | 0 | 0 | 0 | 0 | 0 |

The setup has mass 38 on the centre or axial cup "Ax", and the remaining Argon isotopes on the lower or higher mass collectors respectively.

For cross calibration purposes, for example (other purposes are possible), the mass spectrometer can be set to have another mass at the centre collector, such as mass 39.

| | H2 | H1 | Ax | L1 | L2 |
|---|---|---|---|---|---|
| nominal mass [u] | | 40 | 39 | 38 | 37 |
| actual steering voltage [V] | 0 | 50 | 480 | 530 | 480 |
| Steering corr. [V] | 0 | 0 | 0 | 0 | 0 |

However, by appropriate settings of the steering plates the peaks can be re-centred.

| | H2 | H1 | Ax | L1 | L2 |
|---|---|---|---|---|---|
| nominal mass [u] | | 40 | 39 | 38 | 37 |
| actual steering voltage [V] | 0 | 550 | 450 | 550 | 200 |
| Steering corr. [V] | 0 | 500 | −30 | 20 | −280 |

Similarly, the mass axis may be shifted by another mass unit (signals in H1 and H2 are again from "background" molecules) and again the masses can be re-aligned using appropriate steering plate settings.

| | H2 | H1 | Ax | L1 | L2 |
|---|---|---|---|---|---|
| nominal mass [u] | | | 40 | 39 | 38 |
| actual steering voltage [V] | 250 | 400 | 700 | 450 | 0 |
| Steering corr. [V] | 250 | 350 | 220 | −80 | −480 |

The method can also be used to remove molecular interferences, for example low mass range elements have a lower mass than molecules (mass defect) and thus the beam can be steered to bring the low mass into the detector, removing the higher mass molecular interference.

The per beam adjustment also allows the use of narrower slits than has been commonplace, because minor maladjustments are no more fatal for the measurement but may be compensated by adequate steering. Theoretically it may as well be possible to eliminate interferences on both sides of mass.

Figure 8:
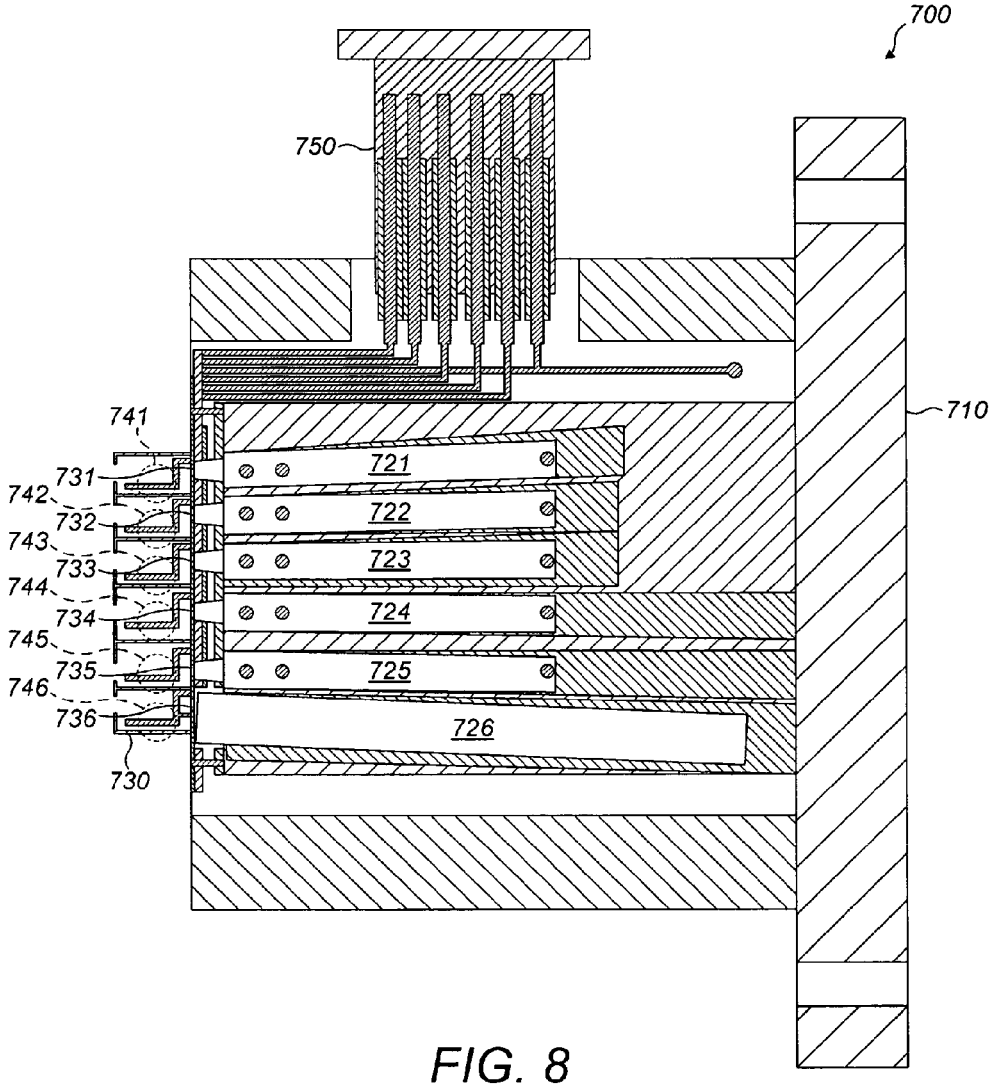
FIG. 8 shows a cross-section view of a fifth and preferred embodiment of the present invention.

Referring next to FIG. 8, there is shown a cross-section view of a fifth and preferred embodiment of the present invention. This illustrates the present invention as embodied as a detection arrangement 700 within the ARGUS VI mass spectrometer. The detection arrangement 700 comprises: a flange 710; a detector system; a deflector system; a shielding arrangement 730; and feedthrough wiring 750.

The detector system comprises: a first Faraday cup (collector) 721; a second Faraday cup 722; a third Faraday cup 723; a fourth Faraday cup 724; a fifth Faraday cup 725; and a Secondary Electron Multiplier (SEM) 726. The deflector system comprises: a first deflector 741; a second deflector 742; a third deflector 743; a fourth deflector 744; a fifth deflector 745; and a sixth deflector 746. Each deflector corresponds with a respective detector.

The shielding arrangement defines: a first beam defining aperture 731; a second beam defining aperture 732; a third beam defining aperture 733; a fourth beam defining aperture 734; a fifth beam defining aperture 735; and a sixth beam defining aperture 736. The shielding arrangement 730 comprises a respective housing for each deflector. The shielding arrangement 730 also defines respective ion entrance apertures for each deflector, upstream from the deflector. The relative sizes of the ion entrance apertures and the beam defining apertures can also be seen.

The detector arrangement is operated in a similar manner to that described in connection with FIG. 3 above.

Figure 9:
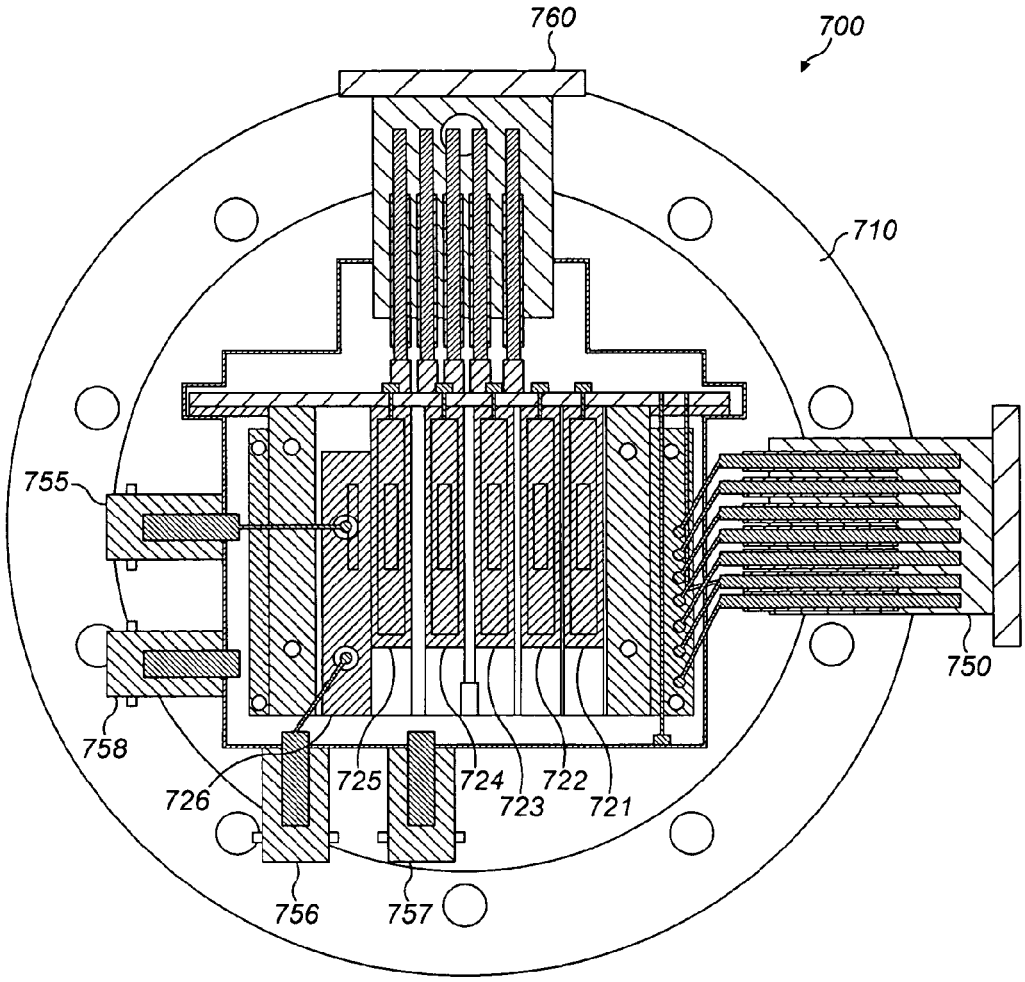
FIG. 9 shows a cross-section view of the embodiment shown in FIG. 8 from the opposite side, highlighting electrical connections between components.

Referring next to FIG. 9, there is shown a cross-section view of the embodiment shown in FIG. 8 from the opposite side, highlighting electrical connections between components. Where the same components as those shown in FIG. 8 are illustrated, identical reference numerals are used. Feedthrough wiring 750 is used to provide voltage supplies to the deflection electrodes. Feedthrough wiring 760 connects the Faraday collector cups 721, 722, 723, 724, 725 to the detector electronics. Further feedthrough 755 provides a single wire voltage supply for the SEM 726 and feedthrough 756 is for connection of the SEM 726 to the respective detection electronics. Feedthrough 757 and feedthrough 758 are spare for one or more optional SEM replacing the collector 724 or collector 725 respectively.

Figure 10A:
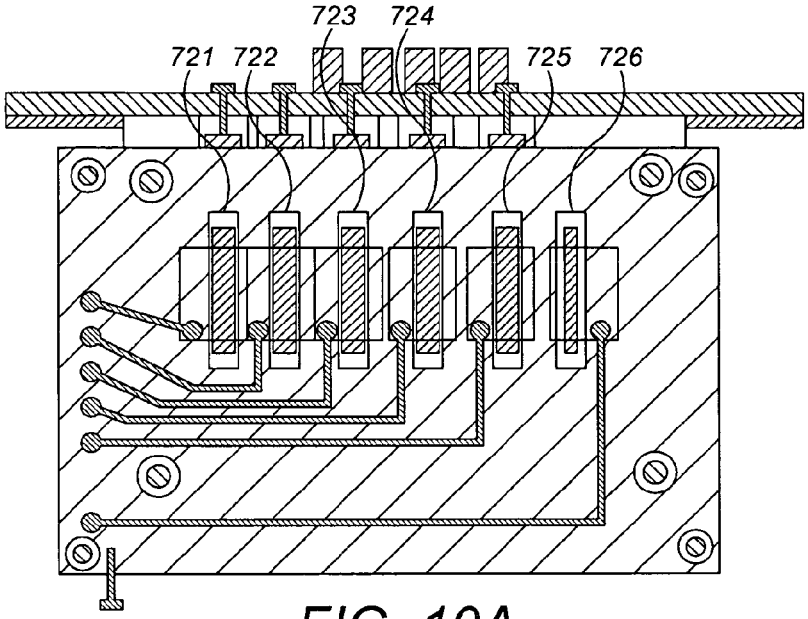
FIG. 10A shows a front view of the embodiment shown in FIG. 8.

Turning to FIG. 10A, this shows a front view of the embodiment shown in FIG. 8, particularly the detector area. This view looks downstream from the dispersive element, which in this embodiment is a magnet.

Figure 10B:
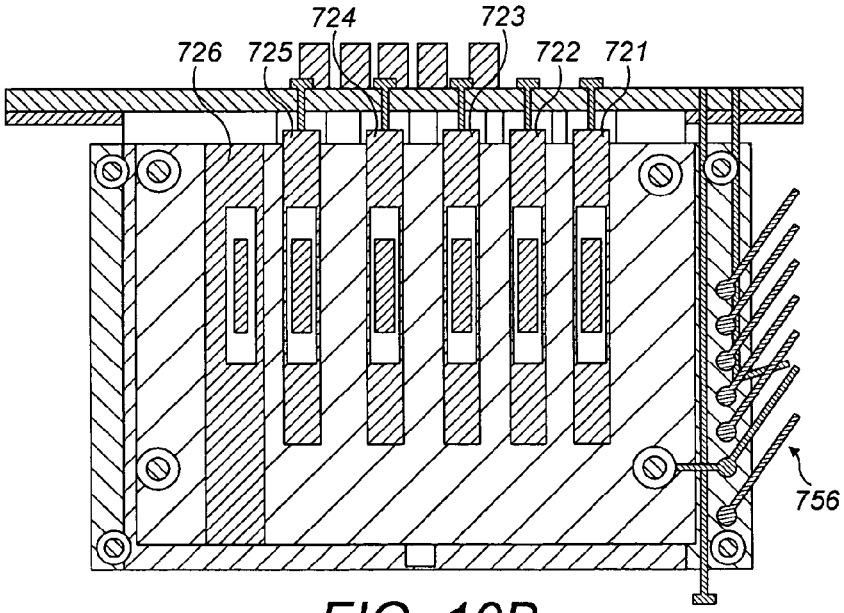
FIG. 10B shows a back view of the embodiment shown in FIG. 8.

In FIG. 10B, there is shown a back view of the embodiment shown in FIG. 8. This shows wiring 756 going to the feedthrough 750 shown in FIG. 8.

Whilst preferred embodiments have been described above, the skilled person will recognise that the present invention can be implemented in a number of alternative ways. For example, a zoom lens may be used in combination with any of the embodiments described above. Then, the ion detection arrangement can provide fine tuning of the dispersion by use of deflection plate electrodes.

In practice, the dispersive element (in the mass analyzer, not shown) is operated at a first setting to project a first set of ions onto the detectors. The zoom lens (not shown) is operated with a first magnification to adjust the spacing of the first ion beams to the spacing of the detectors and the deflectors are set to a first setting, for optimal entry of the first ions beams into the detector openings. Then, the dispersive element is operated at a second setting to project a second set of ions onto the detectors. Similarly, the zoom lens is operated at a second magnification to adjust the spacing of the second beams of ions to the spacing of detectors and the deflectors are set to a second setting for optimal entry of the second ion beams into the detector openings.

The magnification of the zoom lens could be set to vary in the range around 1 (such as between 0.5 and 1.5) or optionally in a range of higher magnifications, for instance from 2 to 5, or in a range of lower magnifications, such as from 0.2 to 0.6. This may be dependent on whether a compact instrument or a high resolution is the main target.

Where a plurality of detectors are used, the present invention can also be used to detect two groups of ions, the first group of ions having approximately half the mass of the second group of ions. Alternate detectors are then used to detect the two groups.

When a zoom lens is used, as described above, it may also be advantageous to select the zoom factor such that only every other detector is used (for example for low masses, such as scandium), while for high masses (like hafnium) every detector may be used. This combination allows the resolution and accuracy of an instrument with moveable detectors to be achieved using a zoom lens and fixed detectors.

Although two steering plate electrodes are shown in each embodiment, the invention can also be implemented using only one steering plate electrode. Other shapes of electrode can also be employed.

Other possible applications of the present invention include: cross calibration; "multi collector jumps"; and verification of intensity measurements.

The invention claimed is:

1. A mass spectrometer, comprising:

a mass analyzer, comprising a mass-to-charge dispersive element, the mass analyzer being arranged to receive ions, to angularly separate the ions according to their mass-to-charge ratios along a dispersive plane and to focus ions of different mass-to-charge ratios in different beams at respective different focal points on a focal plane;

an ion deflector, arranged downstream from the dispersive element to deflect ions in at least one of the different beams leaving the mass analyzer in the dispersive plane;

a shielding arrangement, located between the dispersive element and the ion deflector and being arranged to select the at least one of the different beams to be deflected by the ion deflector;

a beam defining aperture, located downstream from the ion deflector and substantially at the focal plane of the mass analyzer; and at least one ion detector, located downstream from the beam defining aperture.

2. The mass spectrometer of claim 1, wherein the shielding arrangement comprises a beam limiting aperture having a width in the dispersive plane so as to select the at least one of the different beams from the mass analyzer, and wherein the beam defining aperture has a width in the dispersive plane that is narrower than the width of the beam limiting aperture.

3. The mass spectrometer of claim 1, wherein the beam defining aperture is at a location displaced from the focal plane by a distance that is small in comparison with the depth of focus of the mass analyzer.

4. The mass spectrometer of claim 1, wherein the ion deflector comprises at least one plate electrode coupled to a voltage source for generating a potential to deflect ions passing through the ion deflector.

5. The mass spectrometer of claim 4, further comprising a controller, arranged selectively to set the voltage source to provide a first potential such that ions are deflected by the ion deflector by a first amount and to provide a second potential such that the ions are deflected by the ion deflector by a second amount.

6. The mass spectrometer of claim 4, wherein the beam defining aperture is a first beam defining aperture of a first width, the mass spectrometer further comprising a second beam defining aperture of a second width, located downstream from the ion deflector and at the focal plane of the mass analyzer, the at least one ion detector being located downstream from the second beam defining aperture, and further comprising a controller arranged to control the ion deflector to deflect separated ions such that some of the separated ions pass through the first beam defining aperture and some of the separated ions pass through the second beam defining aperture.

7. The mass spectrometer of claim 4, further comprising a controller, arranged to set the voltage source to provide a potential such that ions of a first range of mass-to-charge ratios are deflected by the ion deflector by a first amount and such that ions of a second range of mass-to-charge ratios are deflected by the ion deflector by a second amount.

8. The mass spectrometer of claim 5, wherein the first amount is zero and the second amount is greater than zero.

9. The mass spectrometer of claim 1, wherein the ion deflector is a first ion deflector, the beam defining aperture is a first beam defining aperture and the at least one ion detector is at least one first ion detector, the mass spectrometer further comprising:

a second ion deflector, located downstream from the dispersive element of the mass analyzer;

a second beam defining aperture; and at least one second ion detector, located downstream from the second beam defining aperture and spaced from the at least one first ion detector in the dispersive plane by a predetermined distance.

10. The mass spectrometer of claim 9, wherein the first ion deflector comprises at least one first plate electrode coupled to a voltage source for generating a first potential to deflect ions passing through the first ion deflector and the second ion deflector comprises at least one second plate electrode coupled to a voltage source for generating a second potential to deflect ions passing through the second ion deflector.

11. The mass spectrometer of claim 1, wherein the at least one ion detector is located at a fixed position.

12. The mass spectrometer of claim 1, wherein the at least one ion detector comprises a Faraday cup.

13. The mass spectrometer of claim 1, wherein the at least one ion detector comprises an electron multiplier.

14. A method of operating a mass spectrometer, comprising:

receiving ions at a mass analyzer;

angularly separating the received ions along a dispersive plane according to their mass-to-charge ratios using a dispersive element of the mass analyzer;

causing the separated ions to be focused in different beams at respective different focal points on a focal plane;

deflecting separated ions in at least one of the different beams downstream of the dispersive element using an ion deflector, such that at least some of the separated ions in the at least one of the different beams pass through a beam defining aperture, located substantially at the focal plane;

providing shielding between the dispersive element of the mass analyzer and the ion deflector so as to select the at least one of the different beams leaving the mass analyzer to be deflected by the ion deflector; and detecting ions passing through the beam defining aperture.

15. The method of claim 14, wherein the shielding arrangement comprises a beam limiting aperture, the method comprising:

causing separated ions to pass through the beam limiting aperture, the beam limiting aperture having a width in the dispersive plane so as to select the at least one of the different beams from the mass analyzer; and wherein the beam defining aperture has a width in the dispersive plane that is narrower than the width of the beam limiting aperture.

16. The method of claim 14, wherein the beam defining aperture is at a location displaced from the focal plane by a distance that is small in comparison with the depth of focus of the mass analyzer.

17. The method of claim 14, wherein the step of deflecting ions is carried out using an ion deflector comprising at least one plate electrode coupled to a voltage source for generating a potential to deflect ions passing through the ion deflector.

18. The method of claim 17, wherein the step of deflecting ions comprises selectively setting the voltage source: to provide a first potential such that ions are deflected by the ion deflector by a first amount; and to provide a second potential such that the ions are deflected by the ion deflector by a second amount.

19. The method of claim 14, wherein the ions received by the mass analyzer comprise ions of a first species and ions of a second species, and wherein the step of deflecting ions separated by the mass analyzer is such that ions of the first species separated by the mass analyzer pass through the beam defining aperture and ions of the second species separated by the mass analyzer do not pass through the beam defining aperture.

20. The method of claim 17, wherein the step of deflecting ions comprises:

setting the voltage source to provide a potential such that ions of a first range of mass-to-charge ratios are deflected by the ion deflector by a first amount; and setting the voltage source to provide a potential such that ions of a second range of mass-to-charge ratios are deflected by the ion deflector by a second amount.

21. The method of claim 18, wherein the first amount is zero and the second amount is greater than zero.

22. The method of claim 14, wherein the ions comprise ions of a first species, and further comprising:

prior to the receiving step obtaining a first mass spectrum for a combination of ions of the first species and ions of a second species; and obtaining a second mass spectrum for ions of the first species from the detecting step.

23. The method of claim 22, wherein the second mass spectrum for ions of the first species is obtained at a higher resolution than the resolution of the first mass spectrum.

24. The method of claim 14, wherein the beam defining aperture is a first beam defining aperture and wherein the step of detecting ions is carried out in a first detector, the method comprising:

deflecting ions separated by the mass analyzer, such that at least some of the separated ions pass through a second beam defining aperture, located substantially at the focal plane; and detecting ions passing through the second beam defining aperture in a second detector, located a predetermined distance from the first detector in the dispersive plane.

25. The method of claim 24, wherein the step of deflecting ions such that at least some of the separated ions pass through a first beam defining aperture comprises applying a first potential to at least one first plate electrode, and wherein the step of deflecting ions such that at least some of the separated ions pass through a second beam defining aperture comprises applying a second potential to at least one second plate electrode.

26. The method of claim 14, wherein the step of detecting ions is carried out using an ion detector located at a fixed position.

27. The method of claim 14, wherein the step of detecting ions is carried out using a Faraday cup.

28. The method of claim 14, wherein the step of detecting ions is carried out using an electron multiplier.

* * * * *